United States Patent [19]

Ellis

[11] 4,288,109

[45] Sep. 8, 1981

[54] CORROSION RESISTANT ASSEMBLY AND METHOD OF MAKING IT

[75] Inventor: Claude E. Ellis, Wausau, Wis.

[73] Assignee: Sterling Drug, Inc., New York, N.Y.

[21] Appl. No.: 4,662

[22] Filed: Jan. 19, 1979

[51] Int. Cl.[3] ..... F16L 3/04

[52] U.S. Cl. ..... 285/158; 285/286; 285/422

[58] Field of Search ..... 285/286, 158, 422; 165/173, 178; 29/157.4

[56] References Cited

U.S. PATENT DOCUMENTS

| | | | |
|---|---|---|---|
| 2,183,043 | 12/1939 | Kerr | 285/286 X |
| 2,349,792 | 5/1942 | Rosenblad | 285/286 X |
| 2,966,340 | 12/1960 | Chapman | 285/286 X |
| 3,078,551 | 2/1963 | Patriarca et al. | 285/286 X |
| 3,216,749 | 11/1965 | Summerfield | 285/137 R |
| 4,071,083 | 1/1978 | Droin | 165/173 |

FOREIGN PATENT DOCUMENTS

| | | | |
|---|---|---|---|
| 394129 | 6/1933 | United Kingdom | 285/286 |

*Primary Examiner*—Dave W. Arola
*Attorney, Agent, or Firm*—Charles R. Fay

[57] ABSTRACT

An assembly including a series of tubes attached to a base tube sheet wherein the tube sheet is provided with relatively light corrosion resistant material at both sides, the sheet then being drilled through, corrosion resistant sleeves placed in the holes drilled, and corrosion resistant tubes located and fixed in the sleeves by rolling and welding.

6 Claims, 5 Drawing Figures

FIG. 1
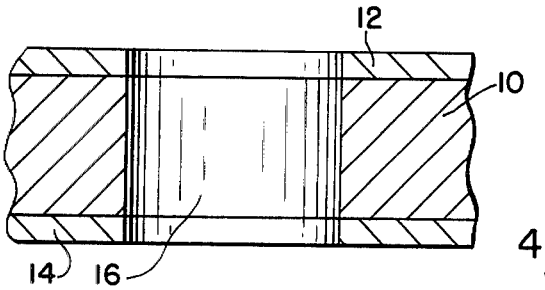
FIG. 2
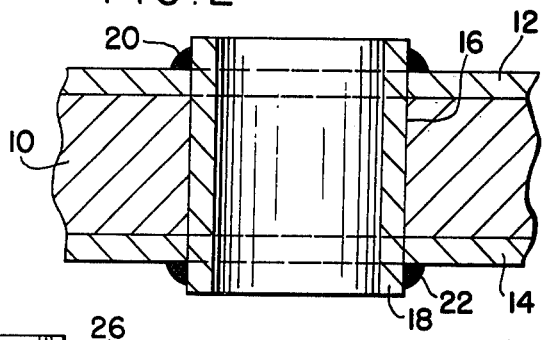
FIG. 3
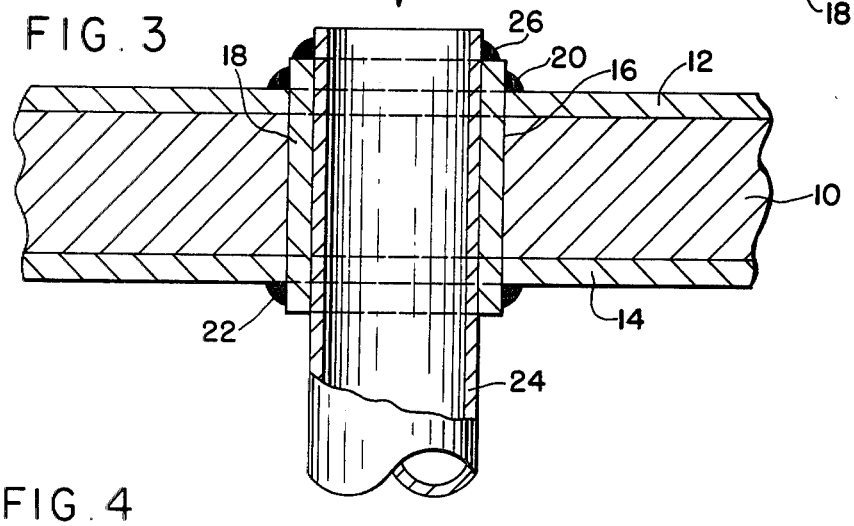
FIG. 4
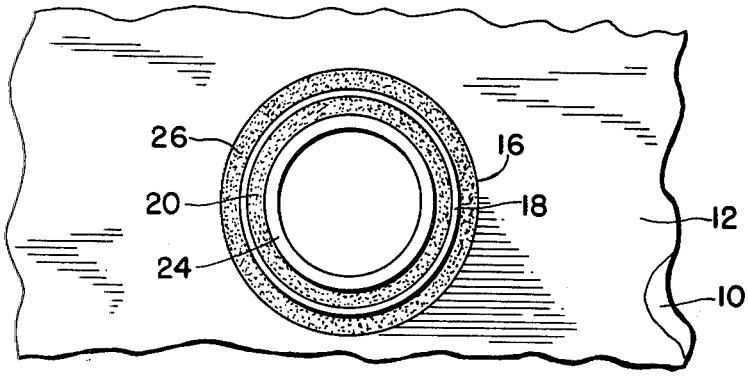
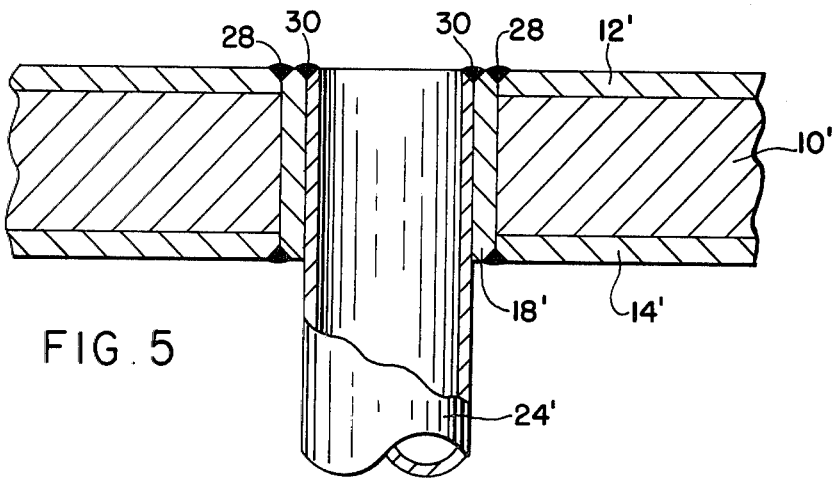
FIG. 5

CORROSION RESISTANT ASSEMBLY AND METHOD OF MAKING IT

BACKGROUND OF THE INVENTION

In a multiple tube and shell heat exchanger, tube sheets are used to separate the channel sections from the shell section. Tubes are inserted through holes in the tube sheets which allow a normally hot fluid to be passed from the inlet channel section through the tubes to the outlet channel section, while segregating this fluid from the heat absorbing fluid passed through the shell space. Typically, the tubes are sealed o the tube sheets by rolling and brazing or welding. Such heat exchangers are in common use.

Since the tube sheets are exposed to both the hot and heat absorbing fluids, they must be constructed of material or materials which are compatible with both fluids. In cases where the hot fluid is corrosive, the tube sheets are often clad with resistant material such as titanium; the tubes are constructed of the same material. The base metal, usually carbon steel, supplies the required strength to the tube sheets while titanium, which has a low allowable stress at elevated temperatures, provides the necessary corrosion resistance. To prevent deterioration of the tube sheet, the corrosive fluid must not be allowed to contact the base metal. Therefore, the tubes are welded directly to the cladding material on the channel side of the tube sheet.

Because of the required tight spacing of the tubes on the shell side of the tube sheets, it is not possible to weld the tubes to a shell-side cladding. Therefore, in applications where it is necessary to provide corrosion resistance to both sides of the tube sheet, it has been necessary to construct the tube sheet from a solid piece of titanium. At elevated temperatures (120°-300° C.), titanium has a very low allowable stress, requiring an extremely thick, heavy and expensive tube sheet to withstand high pressures (300-3,000 psig). A tube sheet of sufficient thickness to withstand this pressure is usually impractical, since the cost of the metal is high and drilling precision holes through thick metal presents difficulties.

In a heat exchanger e.g. that requires both titanium tubes and shell, titanium tube sheets are required. At high temperatures, titanium becomes weak and if a large pressure differential exists across a tube sheet, it may have to be designed to be very thick. This thickness for a tube sheet 18" in diameter operating at 290° with a design pressure differential of 2000 psig would be more than ten inches thick.

This would be a very expensive piece of metal and further, it becomes very difficult to drill straight holes through a piece of metal ten inches thick.

In addition, welding the tubes to the shell side of the tube sheet (whether cladding, lining or base metal) can be virtually impossible due to close tube spacing, and further is undesirable because subsequent removal of a tube or tubes for repair or replacement is difficult.

An object of this invention is the construction of an assembly e.g. heat exchanger tube sheets which are corrosion resistant on both shell and channel sides, preventing contact of corrosive fluid with any non-resistant materials.

A specific object is to reduce the amount of expensive corrosion-resistant metal required by utilizing thin layers of cladding or lining over both sides of the tube sheet base metal, using resistant sleeves, and resistant tubes in the sleeves.

An additional object is to make removal of any one or more tubes possible without the removal of weld metal from the shell side of the tube sheets.

SUMMARY OF THE INVENTION

A tube sheet consists of a double cladding or laminate (both sides) of corrosion resistant material over a plate of base metal, such as steel, with oversize holes drilled through the tube sheet. Corrosion resistant sleeves are pressed into each hole and welded to the cladding or laminate on both sides of the tube sheet. The sleeves are then bored to the proper interior size for tube insertion.

The resulting tube sheet replaces a much thicker tube sheet constructed entirely of the corrosion resistant metal. The resistant tubes are inserted into the holes through the sleeves, and rolled, optionally followed by welding to the sleeve on the channel side only. Alternately, welding without rolling is possible. Any seepage of fluid on the shell side between the tubes and tube sheet sleeve inserts will not result in corrosion, since the base metal (such as carbon steel) is protected from the corrosive fluid by the sleeve inserts.

This method of construction results in a reduced cost heat exchanger in applications involving high temperature and pressure when both tube and shell fluids require the use of materials such as titanium.

DESCRIPTION OF THE PRIOR ART

U.S. Pat. No. 3,216,749, Nov. 9, 1965, illustrates an assembly of tubes and tube sheets similar to the present assembly, and it shows the close spacing of the tubes that renders welding at the shell side impractical.

In this patent a so-called "charge tube 4" is inserted in the nipple, the pressure resistant sleeve 11 being loosely mounted with respect to the latter, so that it can shift under conditions of heat, etc.; on the other hand, the pressure resistant sleeve 11 can be placed so as to extend all the way through the nipple 5 and the charge tube 4 then placed inside it.

Thus at least in the central portion of FIG. 2 of this patent the charge tube 4 is isolated from the nipple 5 and also from the steel plate 1.

Other United States patents of interest are:

F. M. Young, U.S. Pat. No. 2,368,391, Jan. 30, 1945;

F. X. Brown et al, U.S. Pat. No. 3,257,710, June 28, 1966;

F. X. Brown et al, U.S. Pat. No. 3,367,414, Feb. 6, 1968;

Sheldon S. White, U.S. Pat. No. 3,628,923, Dec. 21, 1971;

Roy Hardwick, U.S. Pat. No. 3,717,925, Feb. 27, 1973;

Rene' H. Droin, U.S. Pat. No. 4,071,083, Jan. 31, 1978.

BRIEF DESCRIPTION OF THE DRAWINGS

FIG. 1 is a sectional view illustrating the first step in the formation of the tube sheet;

FIG. 2 is a similar view illustrating the addition of the resistant sleeve;

FIG. 3 shows the addition of the resistant tube to the sleeve;

FIG. 4 is a plan view looking in the direction of arrow 4 in FIG. 3; and FIG. 5 is a view similar to FIG. 3 showing a modified construction.

PREFERRED EMBODIMENT OF THE INVENTION

The reference numeral 10 indicates a base sheet of strong material, e.g., carbon steel. Thin corrosion resistant sheets 12,14 are applied to the sides of the base sheet, and the relative thickness of the parts 10, 12 and 14 may be taken as illustrative of the tube sheet of a heat exchanger. The channel or unobstructed side carries sheet 12, and the shell side, which is obstructed, has sheet 14. A plurality of holes 16 are drilled in certain selected positions in the assembly 10, 12, 14.

To illustrate this invention only a single hole is necessary to be shown but the arrangement of holes may be e.g. as in U.S. Pat. No. 3,216,749.

The hole is drilled oversize for the reception of corrosion resistant sleeve 18 which is pressed into its hole and welded at both ends to the surrounding sheets 12 and 14 annularly as at 20, 22, at both sides of the sheet. This sleeve as shown extends outwardly at both sides of the base sheet and is fillet welded to receive tube 24 which extends outward past the sleeve 18 and resistant sheet 12, enabling the tube 24 to be joined to the sleeve 18 by a fillet or groove weld 26. The tube, of course extends to the opposite tube sheet, as well-known in the art, where the construction may be the same as illustrated herein.

The tube 24 is rolled and/or welded annularly as at 26 to the sleeve 18 on the channel side but not to the sleeve 18 on the shell side. The welds 20, 22, and 26 anchor the corrosion resistant sheets 12 and 14 in place on the base sheet 10, as well as anchoring the tube in place. When it becomes necessary to remove a tube 24, the accessible weld 26 is easily disrupted and the tube slid out, but were there to be a weld between tube 24 and inner resistant sheet 14, this would not be practicable. Even so, this construction is solid and mechanically long lasting, and provides an assembly e.g. in a heat exchanger at a reduced cost over the use of solid corrosion resistant material for the tube sheets.

In an alternate arrangement, FIG. 5, the sleeve 18' and tube 24' are aligned generally flush to the sheet 12' and joined by groove welds 28 and 30. Where a small amount of leakage from shell side to channel side, or vice versa, can be tolerated, the tube 24' may be tightly pressed in place by rolling without subsequent welding. Moreover, this possibility exists with either the extended tube as shown in FIG. 3, or the flush tube arrangement of FIG. 5.

The thin resistant sheets 12 and 14 may be secured to the base sheet 10 and this is referred to as "cladding", or they may be clamped in place until the process of making the assembly is finished. In the latter case the welds hold the parts in assembled condition.

I claim:

1. A joint for a tube to extend through a steel sheet, there being a hole through the steel sheet, corrosion resistant material at both sides of the steel sheet, a corrosion resistant sleeve located in hole welded to the corrosion resistant material at both sides of the steel sheet, thus isolating the hole from the steel sheet by corrosion resistant material, and a corrosion resistant tube in the corrosion resistant sleeve, said tube being secured to the sleeve at one side only of the sheet, the corrosion resistant sleeve terminating at the exterior surfaces of the corrosion resistant material covering the sides of the steel sheet, and adjacent corners of the corrosion resistant sleeve and sheets on both sides of the tube sheet being bevelled forming V-grooves for welding.

2. The joint of claim 1 wherein the corrosion resistant tube terminates flush with the corrosion resistant material at one side of the sheet.

3. The joint of claim 2 wherein the corrosion resistant tube is rolled to the sleeve.

4. The joint of claim 2 wherein adjacent corners of the tube and sleeve are bevelled forming V-grooves for welding.

5. The joint of claim 1 wherein the tube extends out from the sheet at the other side thereof.

6. The joint of claim 1 wherein the corrosion resistant material is titanium.

* * * * *

UNITED STATES PATENT AND TRADEMARK OFFICE

CERTIFICATE OF CORRECTION

PATENT NO. : 4,288,109

DATED : Sept. 8, 1981

INVENTOR(S) : Claude E. Ellis

It is certified that error appears in the above-identified patent and that said Letters Patent are hereby corrected as shown below:

Cover page [56], "2,349,792 5/1942" should read --2,349,792 5/1944--.

Column 1, line 13, "o" should read --to--.

Signed and Sealed this

Fourth Day of May 1982

[SEAL]

Attest:

GERALD J. MOSSINGHOFF

Attesting Officer

Commissioner of Patents and Trademarks